US005194128A

United States Patent [19]

Beaty et al.

[11] Patent Number: 5,194,128

[45] Date of Patent: * Mar. 16, 1993

[54] METHOD FOR MANUFACTURING ULTRAFINE PARTICLES

[75] Inventors: John S. Beaty, Belmont; Jonathan L. Rolfe, North Easton, both of Mass.

[73] Assignee: Thermo Electron Technologies Corporation, Waltham, Mass.

[ * ] Notice: The portion of the term of this patent subsequent to Nov. 5, 2008 has been disclaimed.

[21] Appl. No.: 739,894

[22] Filed: Aug. 2, 1991

Related U.S. Application Data

[63] Continuation of Ser. No. 378,845, Jul. 12, 1989, Pat. No. 5,062,936.

[51] Int. Cl.[5] ..... H05A 3/00

[52] U.S. Cl. ..... 204/164; 75/336; 423/289; 423/409; 423/439; 423/592; 423/645; 423/659

[58] Field of Search ..... 75/336; 204/164; 423/289, 409, 439, 592, 645, 659

[56] References Cited

U.S. PATENT DOCUMENTS

| | | | |
|---|---|---|---|
| 1,887,577 | 11/1932 | Bridger . | |
| 3,041,672 | 7/1962 | Lyle . | |
| 3,246,114 | 4/1966 | Matvay . | |
| 3,752,610 | 8/1973 | Glazunov et al. . | |
| 3,830,603 | 8/1974 | Blucher et al. . | |
| 3,931,375 | 7/1976 | Blucher et al. . | |
| 3,947,607 | 3/1976 | Gazzard et al. . | |
| 3,975,184 | 8/1976 | Akers . | |
| 4,036,568 | 7/1977 | Morlet et al. . | |
| 4,080,177 | 3/1978 | Boyer | 44/51 |
| 4,080,178 | 3/1978 | Boyer | 44/51 |
| 4,080,179 | 3/1978 | Boyer | 44/51 |
| 4,238,427 | 12/1980 | Chisholm . | |
| 4,276,275 | 6/1981 | Ando et al. . | |
| 4,395,440 | 7/1983 | Abe et al. . | |
| 4,401,695 | 8/1983 | Sopko . | |
| 4,487,162 | 12/1984 | Cann . | |
| 4,492,845 | 1/1985 | Kcjuchko et al. . | |
| 4,505,948 | 3/1985 | Pinkhasov . | |
| 4,512,867 | 4/1985 | Andreev et al. . | |
| 4,547,391 | 10/1985 | Jenkins . | |
| 4,561,892 | 12/1985 | Kumar et al. . | |
| 4,610,718 | 9/1986 | Araya et al. | 75/336 |
| 4,628,174 | 12/1986 | Anthony . | |
| 4,657,187 | 4/1987 | Hayashi . | |
| 4,683,118 | 7/1987 | Hayashi et al. . | |
| 4,714,047 | 12/1987 | Ikeda et al. . | |
| 4,719,095 | 1/1988 | Abe et al. . | |
| 4,732,369 | 3/1988 | Araya et al. . | |
| 4,759,905 | 7/1988 | Walter et al. | 3/24 |
| 4,769,064 | 9/1988 | Buss et al. | 204/164 |
| 5,062,936 | 11/1991 | Beaty et al. | 423/439 |

FOREIGN PATENT DOCUMENTS 0161563 4/1985 European Pat. Off. .

OTHER PUBLICATIONS

Webster's *New Collegiate Dictionary*, G. & C. Merriam Co. (1979), p. 3.

"Particulates Formed by a Stabilized High Voltage Spark Discharge" Alexander Scheeline et al (1981).

"Ultrafine Particles", *Physics Today* (Dec. 1987).

"Deposition of Ultra Fine Particles Using a Gas Jet", Japanese Journal of Applied Physics, vol. 23, No. 12 (Dec. 1984).

*Primary Examiner*—Wayne Langel

*Attorney, Agent, or Firm*—Lorusso & Loud

[57] ABSTRACT

A method for the manufacture of ultrafine particles or atom clusters is disclosed. The ultrafine particles of size between about 10 to 1000 Angstroms are formed by the disruption of the crystal lattice or micrograin structure of the metal, alloy or intermetallic compound in one or both of two spaced electrodes by a high frequency, high voltage, high peak current discharge. The ultrafine particles are not subjected to fractionation as in evaporative processes and accordingly are remarkably predictable in both particle size, distribution of sizes and atomic composition, and also are readily transportable in carrier gases.

14 Claims, 2 Drawing Sheets

METHOD FOR MANUFACTURING ULTRAFINE PARTICLES

CROSS REFERENCE TO RELATED APPLICATIONS

This application is a continuation of copending application Ser. No. 07/378,845 filed Jul. 12, 1989, now U.S. Pat. No. 5,062,936.

BACKGROUND OF THE INVENTION

The present invention generally relates to a method and apparatus for producing high quality ultrafine powders from solid or liquid material. The invention relates specifically to the manufacture of non-fractionated ultrafine powders by eroding solid or liquid electrodes through a high frequency, high voltage, high peak current electric discharge.

There has been a need, hitherto unattained, for a method of manufacturing ultrafine particles of metals, semiconductors and other materials of predictable composition. If sufficiently small, the particles so produced could be levitated in a carrier gas by Brownian motion thereby allowing such powders to be handled and mixed as if they were actually gases. Such materials exhibit properties which make them valuable for many applications, including deposition of coatings and the fabrication of alloys.

The most successful among the known methods for producing ultrafine powders are the high current arc evaporative processes which precede droplet condensation in an inert atmosphere. These processes generally use a high current, low voltage vaporization of the component to be comminuted. Such methods of forming powders can be likened to a welder whose torch is connected to a vacuum cleaner—that is, a plasma arc is induced from an electrode to the material to be powdered, which heats the material and subsequently vaporizes it. The vaporized metal is drawn away and condenses to form fine particles.

There are drawbacks to such known processes. High current arc evaporative processes fractionate the electrode material into elementary components, by distillation, precluding the powders so produced from being of a continuously uniform composition. Furthermore, particle produced by the high current arc evaporative method do not attain the small sizes and predictable size distribution required for many applications.

The nitrides, carbides, hydrides, and borides of metals are extremely valuable materials. However, ultrafine powders of these materials have never been successfully manufactured on a commercial scale. The known processes are not able to produce metals of a proper particle size and consistent composition for reaction with nitrogen, hydrogen, boron or carbon. Commercial production of such powders could be very profitable.

In U.S. Pat. No. 4,732,369, an arc apparatus for producing ultrafine particles is disclosed. According to this patent, ultrafine particles are formed by inclinedly positioning an electrode over a molten mixture of the material to be powdered. An electric arc is generated which vaporizes the molten material. The vaporized material is then transferred through an opening into a collection chamber. In addition, a reactive gas is employed during the production of ultrafine particles. The particles produced by the process described are on the order of 40 Angstroms in size. Because the particles are formed by vaporizing a molten mixture, however, the molten mixture is fractionated as it is evaporated, thus prohibiting the production of a homogenous mixture of particles if the material has more than one component.

In U.S. Pat. No. 4,719,095, a process for producing silicon nitride or silicon carbide powders is disclosed. The process begins with powdered silicon with a particle size in a range of 100 to 1000 Angstroms. This powder is reacted with oxygen to form an ultrafine powder of silicon oxide which is then reacted with a gas containing nitrogen or carbon. The resulting powder is of a size of 100 to 1000 Angstroms. Again, the silicon powder is initially produced by vaporizing silicon and then condensing the resultant gas so fractionation is still a problem.

U.S. Pat. No. 4,610,718 also discloses a process for manufacturing ultrafine particles in which a pair of electrodes are arranged within a vessel and an arc is struck between the electrodes. One of the electrodes is made of the material which is turned into the ultrafine particles. Also required are a material feeder and a power source by which an arc current or an arc voltage is set to a predetermined value so as to generate a plasma current flowing from the end parts of the respective electrodes towards the intermediate parts of the arc. The material feeder feeds a rod-shaped or wire-shaped material in accordance with the consumption of the wire, which allows for continuous production of the ultrafine particles. Again, this process vaporizes the electrodes and subsequently condenses the vapor to produce the ultrafine particles. This method has the drawbacks previously described in the other methods discussed in that the material to be powdered is fractionated when it is vaporized and the particles produced are much larger than can be achieved with the present invention.

The above described patents all detail processes wherein arc melting, vaporization and condensation of the electrodes is performed to produce ultrafine particle mixtures of metals and the like. With such processes, low-boiler elements come off first, followed next by a long period of eutectoid or azeotropic material being produced. This fractionally-distilled mixture is not always desirable, and the present invention described below addresses this shortcoming because the present invention does not produce fractionated materials. The material produced from the invention described below has a consistent composition throughout the process run and does not favor one elementary composition over another.

Thus, there remains a need for producing ultrafine particles with sizes as small as approximately 10 Angstroms in diameter and whose composition can be readily determined and predicted.

SUMMARY OF THE INVENTION

The present invention is an apparatus and method for the manufacture of particles of ultrafine size and having a particular desired composition. These ultrafine particles are achieved by ablation of one or more electrodes using a high frequency, high voltage, high peak current discharge.

The present invention utilizes a chamber in which are positioned electrodes at least one of which contains material to be eroded and into which a carrier gas such as argon is introduced. When high frequency, high voltage is applied to the spaced electrodes, erosion from one or both electrodes begins. Ultrafine particles are torn from the electrode crystal lattice and are of such a small size that they are instantly quenched by the carrier gas, or reacted with carrier gas and quenched by excess carrier gas, and the particles remain in suspension in the gas. An outlet is provided through which the particle-containing-gas flows for subsequent processing steps. These steps may include blending or mixing, reaction with other elements or compounds, or further size separation.

It is therefore an object of the present invention to provide a method for the manufacture of non-fractionated ultrafine particles.

A further object of the present invention is to produce such ultrafine particles having a consistent, predictable composition.

Yet another object of the present invention is to produce ultrafine particles which can be readily suspended in a gas.

It is still a further object of the present invention to manufacture ultrafine particles of compounds by producing ultrafine particles of an element and reacting the particles with carrier gases such as oxygen, hydrogen, deuterium, nitrogen, fluorine or bromine to form ultrafine particles of compounds such as metal oxides, hydrides, nitrides, fluorides, or bromides.

Yet another object of the present invention is to generate ultrafine particles of different materials concurrently and allow them to react to form ultrafine particulates of a third material.

These and other features and objects of the present invention will be more fully understood from the following detailed description and drawing in which corresponding reference numerals represent corresponding parts throughout the several views.

DETAILED DESCRIPTION OF PREFERRED EMBODIMENTS

The present invention is a method and apparatus for the manufacture of non-fractionated ultrafine particles. "Ultrafine" as used herein with reference to the present invention means of a size or equivalent diameter in the range of about 10 to 1000 Angstroms. Alternatively, ultrafine particles may be considered as atom clusters containing between about 20 atoms to 10 million atoms. The ultrafine particles are produced by the disruption of the crystal lattice of an electrode through a high voltage, high frequency, high peak current discharge. With this process quantities of ultrafine particles of materials in predictable compositions can be manufactured, a result which to our knowledge has not previously been possible.

Figure 1A:
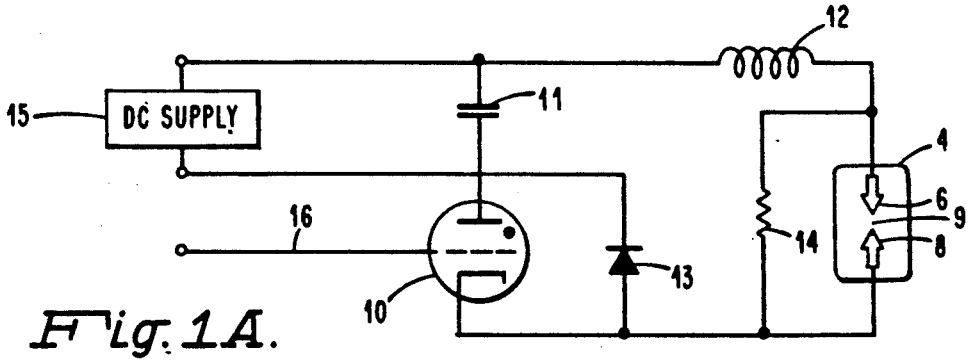
FIG. 1A shows an electrical schematic diagram of a spark generator and reaction chamber for practicing the method of the present invention.

In FIG. 1A, there is shown an electrical schematic of a circuit and reaction chamber 4 suitable for use in carrying out the method of the present invention. This schematic shows a circuit which applies high frequency, high voltage waveforms to two electrodes 6 and 8 which are spaced apart within the reaction chamber 4 to form an inter-electrode spark gap 9 such as a gap of about 6 millimeters. As a high frequency, high voltage spark is applied to the electrodes, mutual erosion of the electrodes begins. Small particles approximately 10–1000 Angstroms in diameter are torn from the electrode lattice. The frequency of the discharges is determined by trigger pulses delivered to a thyratron 10 along a line 16 from a conventional external oscillator (not shown). Also included in the schematic are a capacitor 11 which stores energy for the spark discharge, a coil 12, a diode 13, a resistor 14 and a DC power supply 15. The coil 12 and the resistance and capacitance in the circuit determine the period of oscillation of the current waveform in the circuit of FIG. 1B. The thyratron 10 and diode 13 alternately conduct positive and negative portions of the oscillatory current, respectively, and the spark gap 9 conducts the entire oscillatory current. The waveform (FIG. 2B) produced from the schematic shown in FIG. 1A is a classic LC decay curve with auto-oscillation at a time constant determined by the choice of component values, specifically those of the capacitor 11 and the coil 12.

Figure 2A:
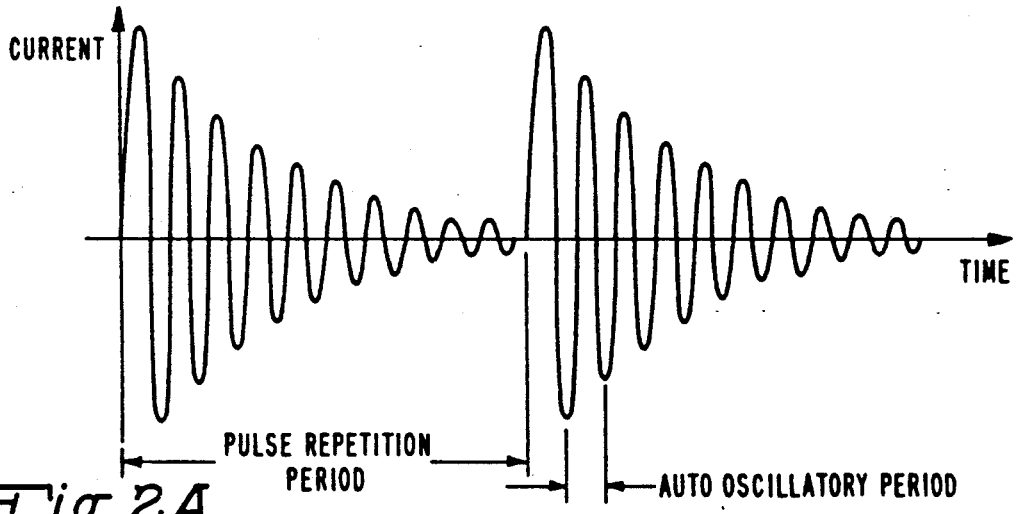
FIG. 2A shows a waveform produced by the electrical circuit of FIG.1A.

In the waveform shown graphically in FIG. 2A current is displayed on the ordinate and time along the abscissa. When the circuit of FIG. 1A is operated in the auto-oscillatory AC mode, both electrodes 6 and 8 will be ablated. That is, the system represented schematically in FIG. 1A produces the waveform shown in FIG. 2A and mutual erosion of both electrodes occurs with a resulting formation of a compound or a mixture of the constituents of both electrodes.

Figure 1B:
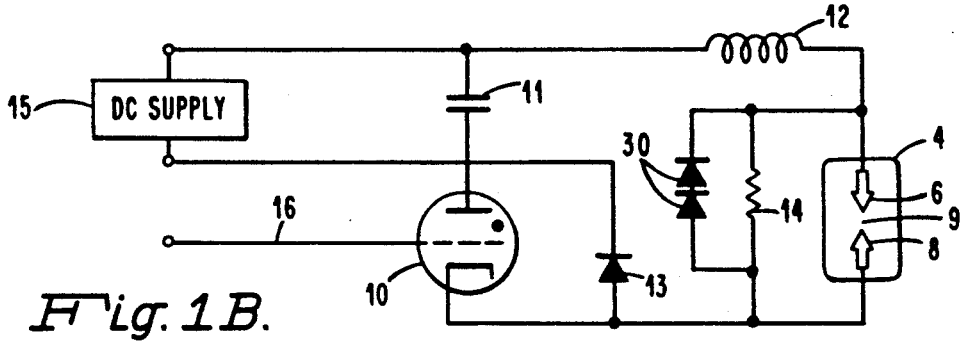
FIG. 1B shows an electrical schematic diagram of an alternate spark generator and reaction chamber for practicing the method of the present invention.
Figure 2B:
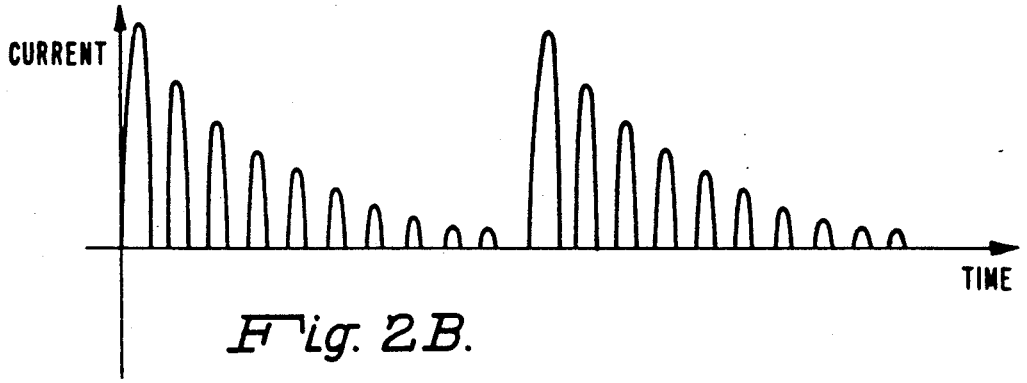
FIG. 2B shows a waveform produced by the electrical circuit of FIG. 1B.

FIG. 1B is a schematic of a circuit and a reaction chamber in which only one of the electrodes is eroded. Again, trigger pulses are sent to a thyratron 10 which switches the current. In addition, a coil 12 and resistor 14 are required. A high voltage diode 30 is installed which clips one of the polarities of the AC waveform shown in FIG. 2A to produce a rectified waveform as shown in FIG. 2B. When the apparatus is operated in this manner only one of the electrodes is eroded. This is desirable for example, in the production of boron nitride wherein boron is comminuted from one electrode in a nitrogen atmosphere. For "single electrode erosion" the non-comminuted electrode acts as a substantially inert conductor; a typical inert electrode is a two percent thoriated tungsten electrode.

Figure 3:
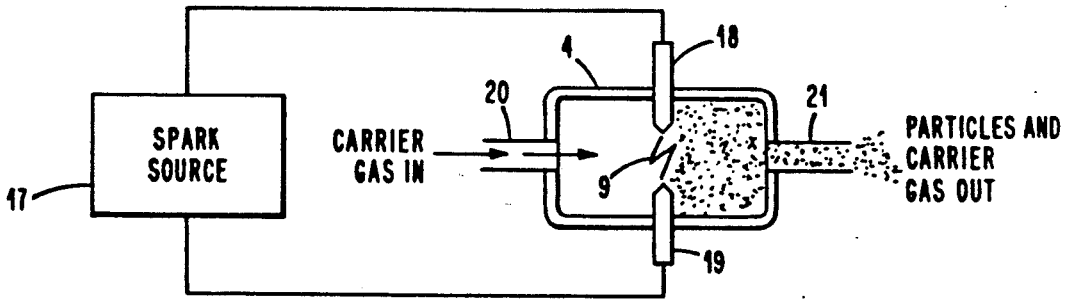
FIG. 3 shows an embodiment of the spark ablation chamber for practicing the method of the present invention.

FIG. 3 shows a typical reaction chamber suitable for use in the practice of the method of the invention. The electrodes 18 and 19 are formed from the material(s) to be eroded. A spark source 17 such as a Thermo-Jarrell Ash electronically-controlled waveform source (ECWS) available from Thermo Jarrell Ash Corporation of Franklin, Mass., is connected across the electrodes 18 and 19, which are formed in part, or entirely, of the material(s) of interest. (The circuitry of the spark source is schematically represented in FIGS. 1A and 1B). Excitation of the spark source 17 by a trigger pulse produces a high voltage, high frequency, high peak current spark which erodes material from one or both electrodes 18 and 19. The resulting particles of the material are instantly quenched, then carried away, by a gas stream such as argon entering the reaction chamber 4 by an inlet 20 and exiting through an outlet 21.

Tests of the above-described method have indicated that the gap or inter-electrode spacing is not a critical parameter for achieving comminution of the electrode(s). A suitable gap during tests has been about 4 to 15 millimeters; however, the optimum gap to maximize production of non-fractionated ultrafine particles is a function of the electrode material, carrier gases and to some extent of the electrical parameters of the spark source which is connected to the reaction chamber in which the electrodes are installed. Also, for manufacture of substantial amounts of ultrafine powders according to the present invention one or both of the electrodes are movable relative to the other by conventional means so that a desired inter-electrode gap may be maintained as either or both electrodes is eroded.

In trials conducted utilizing the method and apparatus of the invention, ultrafine particles were produced in a trimodal distribution. The smallest particles produced had mean particle diameters of approximately 40 Angstroms, the next largest group had a peak at approximately 400 Angstroms, and a third group had a peak at approximately 1000 Angstroms. Details of the particle size distribution depend upon such parameters as spark voltage, current, electrode geometry, choice of carrier gas (e.g. helium, hydrogen, deuterium, neon, argon, xenon, nitrogen, or oxygen), and the gas flow rate. The trials demonstrated that spark erosion can be used to create extremely fine particles. Even the larger sizes produced by the present method are on the order of 10 times smaller than those typically produced from previously known methods. Because of their ultrafine size, the particles produced by this method can be transported for hundreds of feet by a carrier gas stream. Furthermore, these particles can be subjected to chemical reactions while they are entrained in the carrier gas.

The specific conditions of the experiments conducted were that the carrier gas was at a pressure of 100 to 1,000 millibars with a flow rate between 0.5 to 20 liters per minute of the carrier gas. Electrical energy supplied to the electrodes was typically a damped oscillatory current whose duration was from 10 to 200 microseconds, with an oscillatory period from 5 to 20 microseconds in duration. The pulse repetition rate of these pulse trains was between 240 and 5000 per second. Supply starting voltage was greater than 14000 volts (e.g., 17,000 volts), sinking at the instant of conduction to approximately 10 to 100 volts (e.g. 50 volts) with an instantaneous peak current of about 50 to 600 amperes. The RMS current was approximately 2 to 100 amperes. The production rate of the ultrafine powder was approximately 0.025 to 2 grams per minute.

EXAMPLE

An aluminum disk approximately two inches in diameter and one-half inch thick was used as one electrode and was mounted in a reaction chamber at a spacing of about 4 millimeters from an inert electrode of 2% thoriated tungsten. Argon gas at a pressure of approximately 500 millibars with a flow rate of approximately 1.0 liter per minute was introduced into the reaction chamber. The electrical energy supplied was a burst of zero crossing oscillations whose duration was 100 microseconds, with a period of 10 microseconds in duration. The pulse repetition rate of these pulse trains was 240 pulse bursts per second. The supply starting voltage was 17,000 volts, sinking at the instant of conduction to about 50 volts with an instantaneous peak current of about 100 amperes. The RMS current was approximately 5 amperes. The production rate of ultrafine aluminum powder was approximately 0.010 grams per minute, and run time was about two hours in duration, resulting in about a gram of ultrafine powder. The described method produced aluminum particles in a trimodal distribution. Particle size peaks occurred at 40 Angstroms, 400 Angstroms and 1000 Angstroms.

The operating parameters of the above-described example produced similar erosion rates for all of the metals investigated. Also, small quantities of ultrafine particles have been produced from the described method using metal electrodes of carbon steels, nickel-based steels, cobalt, titanium, tungsten, molybdenum, aluminum, magnesium and copper. In addition, materials such as silicon and germanium have also been powdered using this method. Mixtures of materials such as boron nitride, aluminum boride, chromium nitride, and bismuth and tellurium have been successfully used as electrodes. In an interesting example, mercury was successfully comminuted using the process described. Hence, it appears any liquid or solid conducting material may be used as an electrode in this process.

Figure 4:
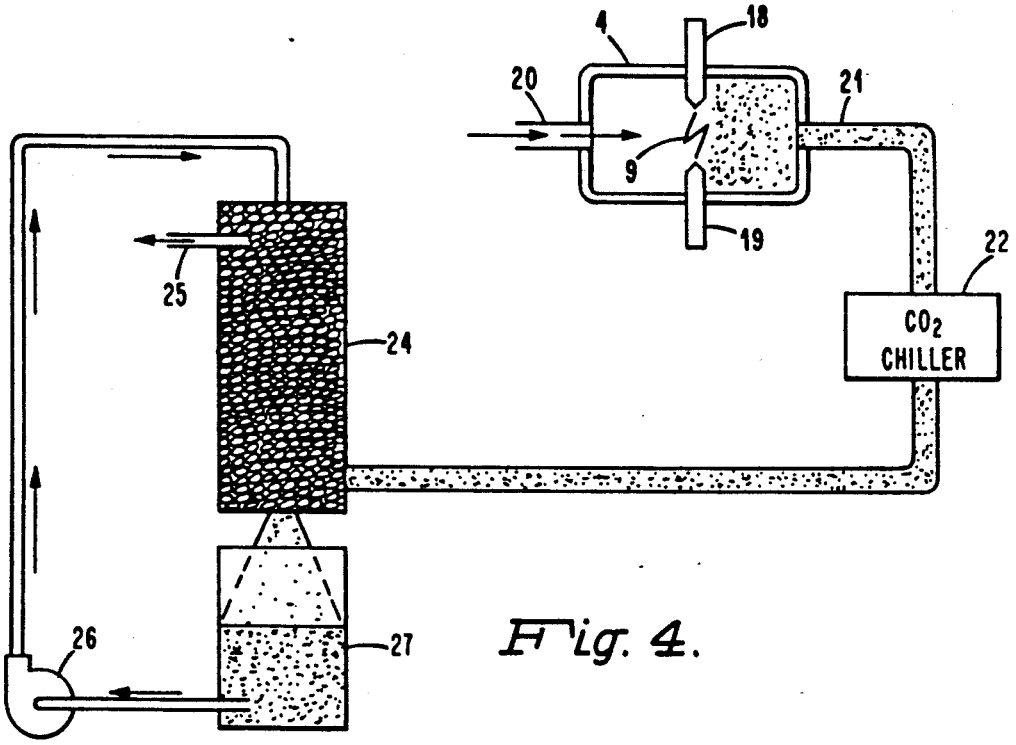
FIG. 4 shows a typical spark ablation chamber and separator for practicing the method of the present invention.

FIG. 4 shows a reaction chamber 4 connected to one type of separation apparatus which is particularly suited for applications for which the desired end product is ultrafine particles suspended in a liquid. This separation apparatus includes a carbon dioxide chiller 22 to precipitate larger particles out of the gas/particle stream. The resulting particles are then concentrated in the liquid which is repeatedly circulated by a pump 26 through a mobile liquid phase absorption bed 24 and a reservoir 27, while the argon is separated by flowing upward through the bed 24, exiting the bed 24 through an outlet 25 in a pure state suitable for re-use. This simple separation apparatus can be used to obtain particles of a specific desired size. The powdered materials produced from the process described may also be separated from the gas phase by methods such as filtration, gas centrification, cryogenic reduction of the gas to a liquid which arrests Brownian levitation, and by electrostatic precipitation. These separation methods are based on currently available hardware and known processes.

Figure 5:
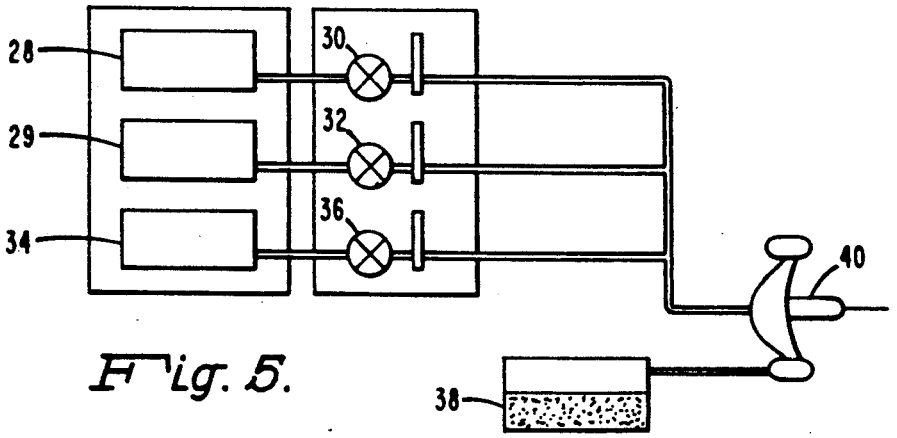
FIG. 5 shows an embodiment of an apparatus for use with the method of the present invention with two spark ablation chambers connected in parallel along with a chamber for providing dopant.

FIG. 5 illustrates a system in which ultrafine particles created in two reaction chambers 28 and 29 by two spark sources (not shown) according to the method of the invention can be combined into a single gas stream, permitting, for example, simultaneous deposition of particles arriving from different sources. The mixing is controlled by adjustable valves 30 and 32. Any or all of the individual particulates may be subjected to chemical reaction before the particle steams ar merged. Alternatively, or in addition, elements—e.g. dopant materials such as boron, arsenic, or others-may be added to the particle stream from a chamber 34 and through a valve 36 for specific applications. If desired, the merged streams may be directed to a collector 38 following their separation from the carrier gas stream by a gas centrifuge 40. Sequential depositions of ultrafine particles from individual sources or combinations of the particles are also possible.

A unique property of the materials produced in the above-described process is their size. The material typically is composed of particles having a mean particle diameter of approximately 40 Angstroms. Thus the particles are atom clusters containing approximately 1,000 atoms, that is, 10 atoms on the side of a cube. Ultrafine particles, because of their large surface areas, can be of considerable utility as reactants or catalysts. Ultrafine particles may readily be transported by gases and are useful in membrane processes in which ultrafine particles pass through barriers and larger ones do not. Ultrafine particles are also important in mixing and distribution.

Typically, metals are eroded in the process of the present invention, but it is also possible to erode non-conductive materials mixed with a conductive material, e.g., alumina and graphite. The resultant ultrafine powder produced by eroding a mixture of alumina and graphite will be a homogeneous composition containing alumina and graphite in the same proportions as provided in the electrode. This is distinguishable from the above-described prior art in that the electrode is eroded or abraded rather than vaporized. When vaporization of the electrode occurs during the practice of a prior art process, the more volatile element, in this case alumina, will come off first, then the carbon or graphite will evaporate. Therefore the resultant mixture of the powder produced from these known processes will vary in composition. That is to say, more alumina powder will be present in the initial product stream with the amount of carbon increasing as more powder is produced.

By contrast, the ultrafine particles manufactured in the process of the present invention are non-fractionated and have a composition which directly reflects that of the electrodes which are comminuted. Importantly, the intermittent, short duration sparks resulting from the high frequency discharges of the spark source cause erosion rather than evaporation of constituents of the electrodes. The intermittent nature of the sparking, together with the ultrafine size of particles produced, allows the heated particles to be quenched by the carrier gas, avoiding sticking of the particles to surfaces within the reaction chamber or exit flow conduits. Also of considerable importance is the gas-like character of the mixture of carrier gas and ultrafine particles, which allows the mixture to be handled, transported and furnished as a reactant as if it were a gas.

An example of an application in which ultrafine particles produced in the process of the present invention is useful is the reaction of metals with oxygen. Generally, metals react spontaneously in oxygen, that is, they oxidize. However, they do not react to completion because of a surface coating of the oxide of the metal which forms on the particle. The reactants (metal and oxygen) are separated by the oxide layer so oxidation is inhibited. In the case of the ultrafine particles manufactured in accordance with the invention, much more of the reactant is readily available for oxidation due to the greater surface area of the ultrafine particles. For example, the surface area of a 1 $cm^3$ cube of material is $6\times10^{-4}$ square meters. The surface area of the equivalent weight of particles at 40 Angstroms is $7.9\times10^{+2}$ square meters. The surface area of the particles is therefore a million and a third times greater than that of the 1 $cm^3$ cube To put this in perspective, 49 percent of the atoms are on the surface of these particles and 78 percent are readily available for reaction whereas less than 0.00000004 percent of the atoms on the surface of a 1 $cm^3$ cube are available for reaction. The reactive nature of metals of ultrafine size causes them to be highly reactive chemical reagents. Such reagents can be used in a variety of ways.

While the foregoing invention has been described with reference to its preferred embodiments, it is not limited to such embodiments since various alterations and modifications will occur to those skilled in the art. The invention is intended to include all such modifications and their equivalents which are within the scope of the appended claims.

What is claimed is:

1. A method of manufacturing non-vaporized ultrafine particles comprising:

providing two electrodes each containing a conductive material;

mounting said electrodes in spaced-apart relationship in a reaction chamber;

repetitively producing a spark between the electrodes to cause non-vaporizing ablation of at least one of the electrodes and formation of ultrafine particles; and carrying said ablated material away from the reaction chamber in a carrier gas.

2. The method of claim 1 including operating the spark source at a voltage of between about 14000 and 20000 volts sinking to a voltage between about 10 and 100 volts during conduction between the electrodes.

3. The method according to claim 1 wherein the electrode-providing step comprises providing a first electrode containing a material to be ablated and providing a second electrode of an erosion-resistant material, and including operating said spark source to produce a rectified current waveform having positive oscillatory currents only so as to ablate material only from said first electrode.

4. The method of claim 3 wherein said first electrode contains at least two materials; such that said step of repetitively producing a spark between the electrodes causes non-fractionating ablation of said first electrode.

5. The method of claim 1 wherein the reaction chamber is supplied with a carrier gas at a pressure of from 100 to 1000 millibars, and carrying said ablated material away from the reaction chamber in said carrier gas.

6. The method of claim 1 wherein the electrode providing step comprises providing as at least one of said electrodes, an electrode containing at least two materials; such that said step of repetitively producing a spark between the electrodes causes non-fractionating ablation of at least one of the electrodes and formation of non-fractionated ultrafine particles.

7. A method of manufacturing non-vaporized ultrafine particles of a specific compound comprising:

providing a first conductive electrode including a first material which is a constituent of said compound and a second conductive electrode including a second material which is a constituent of said compound;

mounting said electrodes in spaced-apart relationship in a reaction chamber;

operating said spark source in a manner to repetitively produce a spark between the electrodes to cause non-vaporizing ablation of portions of said electrodes to yield ultrafine particles of said constituents;

allowing said constituents to react to form ultrafine particles of said compound; and carrying said non-fractionated ultrafine particles of said compound away from said reaction chamber in a carrier gas.

8. The method of claim 7 wherein the electrode providing step comprises providing, as at least one of said conductive electrodes containing a constituent of said compound, an electrode which comprises at least two materials; such that said step of repetitively producing a spark between the electrode causes non-fractionating ablation of said constituent of at least two materials and formation of non-fractionated ultrafine particles of said constituent of at least two materials.

9. A method of manufacturing non-vaporized ultrafine particles of a specific compound comprising:

providing two electrodes each containing a conductive material;

mounting said electrodes in spaced-apart relationship in a reaction chamber;

repetitively producing a spark between the electrodes to cause non-vaporizing ablation of at least one of the electrodes;

supplying to said reaction chamber a gas reactive with the ablated material and allowing said gas and said ablated material to react to form ultrafine particles of said specific compound; and carrying said ultrafine particles of said compound away from said reaction chamber in a carrier gas.

10. The method of claim 9 wherein a single gas is supplied to said reaction chamber for reacting with said ablated material and for carrying away the ultrafine particles of said compound.

11. The method of claim 9 wherein the electrode providing step comprises providing, as at least one of said conductive electrodes, an electrode containing at least two materials; such that said step of repetitively producing a spark between the electrodes causes non-fractionating ablation of at least one of the electrodes.

12. A method of manufacturing and combining dual streams of non-vaporized ultrafine particles comprising:

mounting a first pair of conductive electrodes in a spaced-apart relationship in a first reaction chamber;

mounting a second pair of electrodes in a spaced-apart relationship in a second reaction chamber;

repetitively producing a spark between each pair of electrodes to cause non-vaporizing ablation of at least one electrode of each pair and formation of ultrafine particles;

supplying carrier gases to each of said reaction chambers to carry said ablated materials away from said reaction chambers as first and second gas/particles streams; and directing said first and second gas/particle streams to a single flow conduit in a controlled manner to create a blended flow, or sequential flows, of said first and second gas/particle streams.

13. The method of claim 12 further including directing a dopant material to said single flow conduit to dope particles in at least one of said first and second gas/particle streams.

14. The method of claim 12 wherein the electrode mounting step comprises, as providing at least one of said conductive electrodes, an electrode containing at least two materials; such that said step of repetitively producing a spark between a pair of electrodes in which one of said pair contains at least two materials causes non-fractionating ablation of said electrode and formation of non-fractionated ultrafine particles.

* * * * *